United States Patent [19]

Grieshaber et al.

[11] 3,961,477

[45] June 8, 1976

[54] PROCESS AND SYSTEM FOR DETOXICATING THE EXHAUST GASES OF AN INTERNAL COMBUSTION ENGINE

[75] Inventors: Hermann Grieshaber, Stuttgart; Wolf Wessel, Schwieberdingen, both of Germany

[73] Assignee: Robert Bosch G.m.b.H., Stuttgart, Germany

[22] Filed: Jan. 3, 1975

[21] Appl. No.: 538,243

[30] Foreign Application Priority Data

Jan. 12, 1974 Germany ..... 2401417

[52] U.S. Cl. ..... 60/274; 60/276; 60/278; 60/285; 60/290; 60/301

[51] Int. Cl.[2] ..... F02B 75/10

[58] Field of Search ..... 60/274, 276, 278, 290, 60/301, 285

[56] References Cited

UNITED STATES PATENTS

| | | | |
|---|---|---|---|
| 3,662,540 | 5/1972 | Murphey | 60/301 |
| 3,827,237 | 8/1974 | Linder | 60/276 |
| 3,832,848 | 9/1974 | Scholl | 60/274 |

*Primary Examiner*—Douglas Hart
*Attorney, Agent, or Firm*—Edwin E. Greigg

[57] ABSTRACT

For detoxicating the exhaust gases of an internal combustion engine an in-series arrangement of a first reactor and an oxidizing reactor is provided with the exhaust line of the engine along with an oxygen measuring element and structure for producing two additional air streams fed to the exhaust line. The first reactor reduces the nitrogen oxides in the exhaust gas and the second or oxidizing reactor oxidizes the hydrocarbons and the carbon monoxide in the exhaust gas. The oxygen measuring element is mounted to the exhaust line and regulates the mass ratio of air to fuel on the suction side of the engine. The first additional air stream is injected into the exhaust pipe in the flow direction upstream of the oxygen measuring element. The quantity of this air stream is regulated and corresponds to the fuel throughput of the engine so that when the oxygen measuring element measures a stoichiometric mixture ($\lambda=1$) a slightly rich air-fuel mixture ($\lambda\approx0.98$–$0.99$) is supplied to the engine.

16 Claims, 7 Drawing Figures

Fig.1
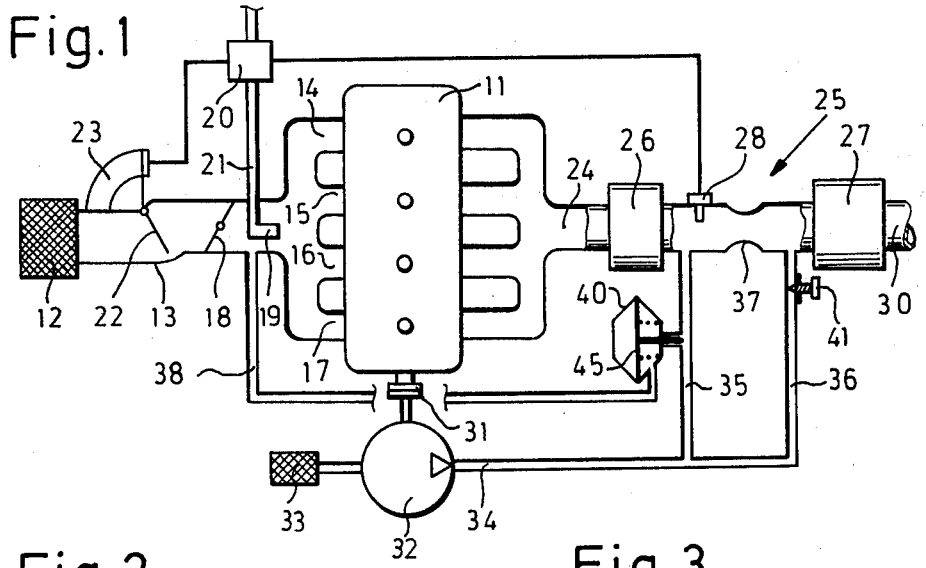
Fig.2
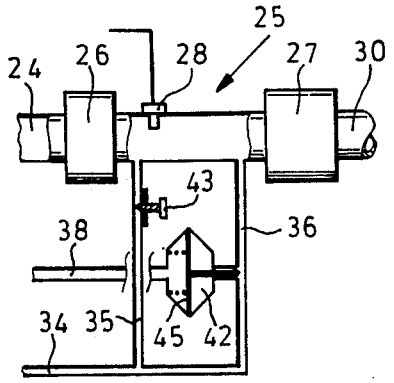
Fig.3
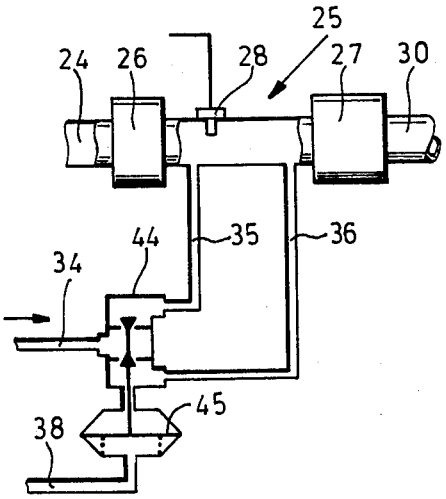
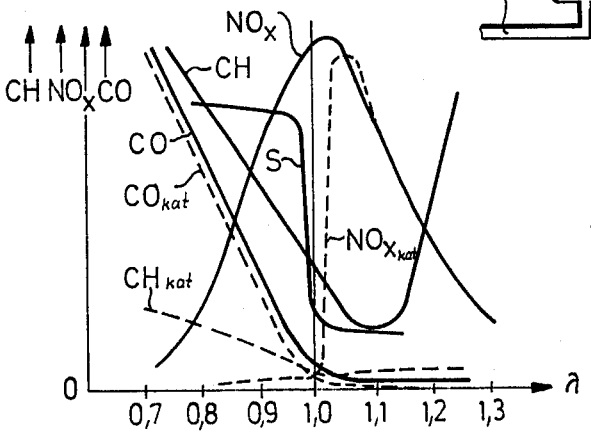
Fig.4

PROCESS AND SYSTEM FOR DETOXICATING THE EXHAUST GASES OF AN INTERNAL COMBUSTION ENGINE

BACKGROUND OF THE INVENTION

The present invention relates to a process and system for detoxicating the exhaust gases of an internal combustion engine, the exhaust pipe of which contains an in-series arrangement of a first reactor for reducing the nitrogen oxides in the exhaust and a second reactor for oxidizing the hydrocarbons and the carbon monoxide in the exhaust. This process operates with a first control system which regulates the mass ratio of air to fuel on the intake side of the engine as a function of the quantity measured by an oxygen measuring element disposed in the exhaust pipe and with at least a second control system which controls the injection of supplementary air into the exhaust pipe in the direction of flow upstream of the oxidizing reactor.

With exhaust gas detoxicating systems of this type comprising two bed catalysts, to obtain satisfactory reduction of the nitrogen oxides NOx, the air-fuel mixture supplied to the engine should be slightly richer ($\lambda<1$) than a stoichiometric mixture ($\lambda=1$). By using this slightly richer mixture (slight air deficiency), the combustion temperature in the engine is kept relatively low which counteracts oxygen formation and provides a better drive performance as less misfiring and other disturbing phenomena are produced in the course of combustion when the position of the accelerator is altered rapidly. This slightly richer mixture can be ignited more easily. On the other hand, this produces an increase of carbon monoxide CO and hydrocarbons HC. These substances are thereafter oxidized in the oxidizing catalyst while air is added. The slightly richer mixture is also an advantage to the rapid heating of the oxidizing catalysts as these only operate satisfactorily after reaching a specific operating temperature which is largely dependent on the composition of the catalysts.

Known detoxicating processes of the type described initially operate with a relatively rich air-fuel mixture on the intake side of the engine so that with the constantly varying characteristic values of the engine during operation of an internal combustion engine, it is possible to effectively prevent the engine from occasionally receiving too lean a fuel mixture, resulting in that the additional CO required of reducing NOx is not present. The disadvantage of these known systems is a relatively large, costly air pump for injecting large quantities of additional air into the exhaust pipe, a high efficiency loss and high fuel consumption.

OBJECTS AND SUMMARY OF THE INVENTION

The principal object of the present invention is to provide a detoxicating system of the type described initially by means of which a slightly richer air-fuel mixture ($\lambda = 0.98 - 0.99$) is supplied to the engine, wherein measurements taken on the exhaust side of the engine are effected by an oxygen measuring element which changes its output voltage abruptly, in a manner known per se, when the air number $\lambda = 1$, such that only this air number is utilized for an accurate measurement, and wherein the supplementary air is supplied by a relatively small pump.

This and other objects are accomplished according to the present invention in that the supplementary air supply is divided into two streams and blown into the exhaust pipe, with a first stream being injected in the direction of flow upstream of the oxygen measuring element and being regulated at a quantity corresponding to the gas throughput of the engine so that with a measuring element measurement of a stoichiometric mixture ($\lambda = 1$), a slightly richer air-fuel mixture ($\lambda \approx 0.98 - 0.99$) is supplied to the engine, and with a partial stream of additional air being supplied upstream of the oxygen measuring element, such that a slightly weaker air-fuel mixture is initially detected by the measuring element. Thus, a slightly richer air-fuel mixture is supplied to the engine in correspondence with the first partial stream of additional air. Although the fuel consumption is only slightly higher than when $\lambda = 1$, a reducing or oxidizing atmosphere will be sure to prevail in the catalysts.

According to a feature of the invention, the supplementary air pump is driven by the engine and the first partial stream of supplementary air can be controlled, at least indirectly, in dependence on the pressure in the suction pipe downstream of the engine throttle valve.

According to another feature of the invention the partial stream of additional air is regulatable as a function of the flow conditions in the exhaust line.

Other objects, features and advantages of the present invention will be made apparent from the following detailed description of two preferred embodiments thereof provided with reference to the accompanying drawings which show three variants of the two embodiments.

BRIEF DESCRIPTION OF THE DRAWING

FIGS. 1, 2 and 3 illustrate a first embodiment comprising pressure dependent control of the suction pipe;

FIG. 4 illustrates a diagram representing the composition of the exhaust gas.

DESCRIPTION OF THE PREFERRED EMBODIMENT

Figure 5:
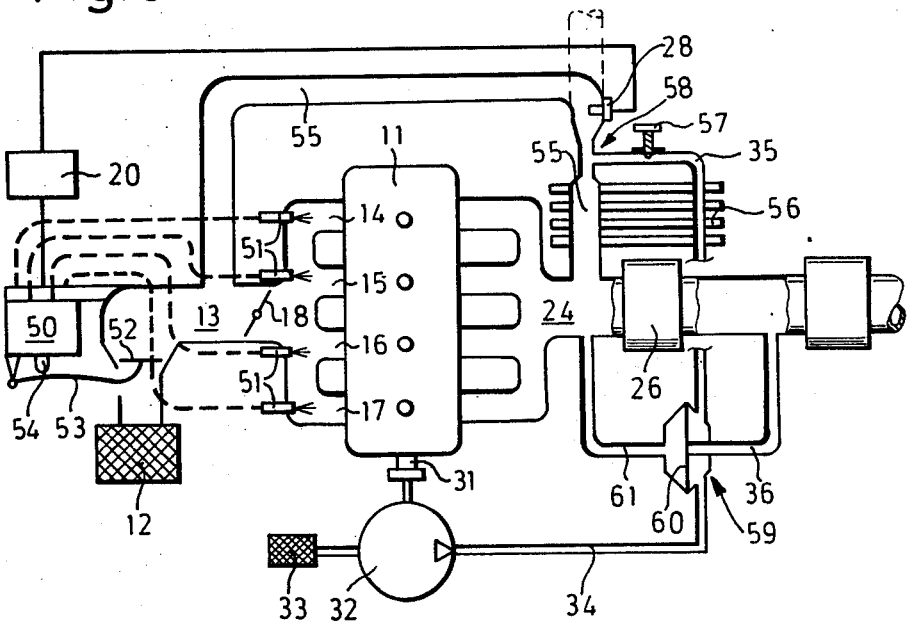
FIGS. 5, 6 and 7 illustrate a second embodiment comprising pressure dependent exhaust line control.

In FIG. 1, an internal combustion engine 11 is shown which draws in air via an air filter 12 and a suction pipe 13. The suction pipe 13 branches into individual suction lines 14–17 which lead to the cylinders of the internal combustion engine 11. An arbitrarily actuatable throttle valve 18 is disposed in the suction pipe 13. Fuel is introduced into the suction pipe 13 via a nozzle 19. The fuel is metered in a control device 20, which also operates by electrical means, and is supplied via a line 21 to the nozzle 19. The air flowing through the suction pipe 13 is measured by means of a baffle valve 22 which cooperates with a potentiometer 23, the electrical output quantity of which corresponds to the quantity of air. This electrical quantity is supplied to the control device 20 so that it can meter a corresponding quantity of fuel.

The exhaust gases from the internal combustion engine 11 are collected in an exhaust gas line 24, in which is disposed a two bed catalyst 25 comprising a first reduction bed 26 and a second oxidizing bed 27. An oxygen measuring element 28 is disposed between the two beds 26 and 27. The electrical output quantity of the measuring element 28 is supplied to the control device 20. The outlet of the two bed catalysts 25 discharges into an exhaust pipe 30 which supplies the exhaust gases to a muffler system (not shown).

An air pump 32 which draws in outside air via a filter 33 and supplies it to the exhaust gas line between the two beds 26 and 27 of the catalyst 25 is driven by the internal combustion engine 11 via a coupling 31, for example, a V-belt. The line 34 divides into a first partial air stream line 35 and a second partial air stream line 36. The line 35 discharges into the exhaust line in the flow direction upstream of the measuring element 28 and the partial air stream line 36 discharges directly upstream of the bed 27. For the purpose of disconnecting the air streams, it may be advantageous to provide a neck portion 37 between the beds 26 and 27. A control line 38 which branches off from the suction pipe 13 downstream of the throttle valve 18 is used to control the air flowing via the first line 35. A second control means which will be described hereinafter is provided to ensure that the quantity of the first partial air stream corresponds to approximately 1 – 2% of the air sucked in.

In a variant of the first embodiment represented in FIG. 1, a valve 40 is disposed in the line 35 which closes this line to an ever greater extent as the vacuum pressure in the suction pipe 13 increases. A throttle 41 is provided in the line 36 to calibrate the air stream through the line 35.

In the variant shown in FIG. 2, the cross-section of the line 36 is controlled by a valve 42 which increases its controlling action as the suction pipe vacuum pressure increases. A throttle 43 is disposed in the line 35 to prevent a corresponding baffle effect.

In the variant shown in FIG. 3 the air from line 34 is divided by a three-way valve 44 into the lines 35 and 36, the total cross-sectional area of the passage to the lines 35 and 36 remaining constant. As the vacuum pressure in the suction pipe 13 increases, the cross-sectional area of the passage to the line 36 increases and the cross-sectional area of the passage to the line 35 decreases. This switching arrangement is advantageous because it prevents additional throttle losses from occurring as in the case of the preceding embodiments through the throttles 41 or 43 and thus the air pump 32 suffers less dissipation loss.

The air valves 40, 42 and 44 preferably operate with a diaphragm 45 activating the movable valve member. Owing to the suction pipe vacuum pressure being brought to bear via the line 38, the membranes 45 are actuatable against the force of return springs.

FIG. 4 is a schematic diagram of the relationship between the composition of the exhaust gas and the air number $\lambda$. When $\lambda = 1$, a stoichiometric mixture is present, that is, a mixture in which theoretically there is just sufficient air to burn all the fuel. In the left half of the diagram are curves representing a slight air deficiency — thus a rich mixture — and in the right half of the diagram are curves representing a less rich mixture. The unbroken lines designate that there are no catalysts and the broken lines indicate that catalysts are present. As is apparent from the diagram, as the air-fuel mixture becomes less rich, the CO value decreases initially very rapidly and after reaching $\lambda = 1$ much more slowly but still in a constant manner. This CO value which is relatively low when $\lambda = 1$ is further reduced by the catalysts, as indicated by the broken line. The CH curve also drops rapidly until $\lambda \approx 1.1$ but then begins to rise steeply. This steep rise is associated with the fact that as the excess air increases, the amount of misfiring tends to increase which results in an increase in unburned hydrocarbons. The corresponding catalysts curve is substantially less steep from the start and reaches a minimum when $\lambda \approx 1.0$. However, it still does not rise substantially when there is an excess of air. On the other hand, the NOx curve behaves in exactly the opposite manner to the CH or CO curves. It reaches a maximum of about $\lambda = 1.05$, but with excessively high and excessively low air count values it drops steeply. This is a result of the fact that nitrogen oxides are only produced at high combustion temperatures by combustion of the nitrogen in the air. However, the combustion temperature reaches its maximum with a slightly less rich air-fuel mixture. By means of the reduction catalyst bed 26 it is possible to obtain the corresponding NOx curve represented by the broken line. This reaches its minimum with a slight air deficiency and follows a very flat and low course when the air-fuel mixture is rich. With a reducing exhaust gas composition, that is, with a rich air-fuel mixture, the nitrogen oxides react with the carbon monoxides and hydrogen from the unburned hydrocarbons in the reduction catalyst 26. For this reason, with lower air counts, that is, with richer air-fuel mixtures, there is only a small amount of nitrogen oxide in the exhaust gas at the output of the reduction catalyst. When $\lambda \approx 0.98 - 0.99$ there is an NOx minimum and with $\lambda \approx 1.02$ the catalyst is no longer active as there is too much oxygen in the exhaust gas for a reducing atmosphere.

As the voltage curve S of the oxygen measuring element 28 indicates, the output voltage of the oxygen measuring element 28 changes abruptly when $\lambda = 1.0$. A $\lambda$ of 1 can thus be easily adjusted. An oxygen measuring element of this type consists of a solid electrolyte which will conduct oxygen ions at higher temperatures such as prevail in exhaust gas flows. Zircon dioxide can be used, for example, as this solid electrolyte.

This abrupt behavior of the oxygen measuring element 28 when $\lambda - 1$ can be used to accurately adjust an air-fuel mixture of $\lambda = 0.98 - 0.99$ without having to employ a complicated analog control system. Combustion air of 1.5–2% is merely supplied to the supply air via the partial air stream line 35 upstream of the measuring element 28. When $\lambda = 1$ on the exhaust gas side, the oxygen measuring element 28 then regulates a slightly rich air-fuel mixture on the suction side. This first partial air stream is only supplied to the exhaust gas line 24 downstream of the reduction catalyst 26 in order not to impair the reduction process. The remaining air which is pumped by the pump 32 is directed via the line 36 upstream of the oxidizing catalyst 27. It is of little importance if more air is injected than is required for oxidation.

Figure 6:
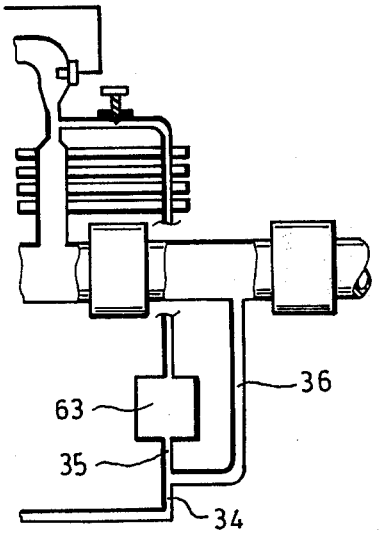
Figure 7:
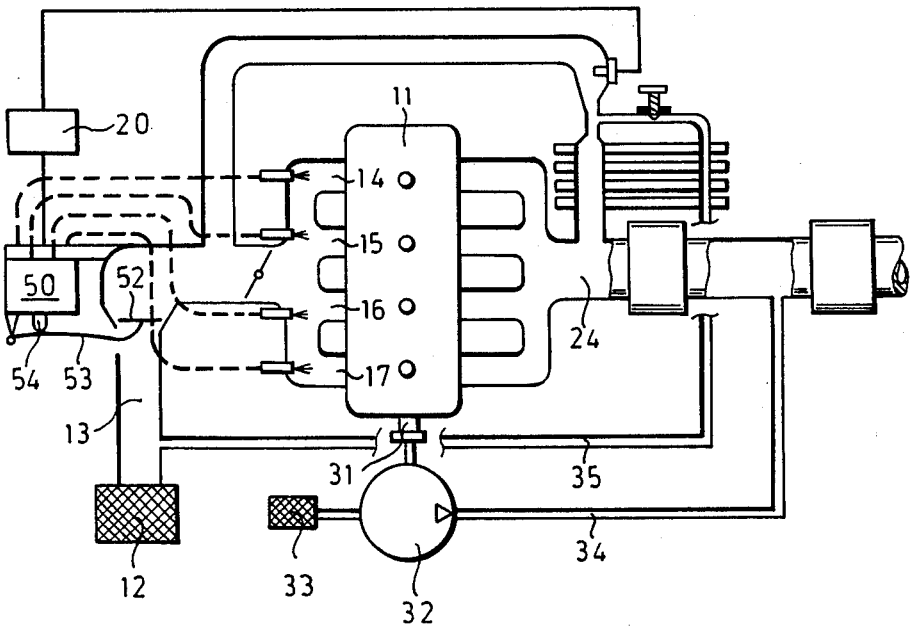

In the three variants of the two embodiments, which are represented in FIGS. 5, 6 and 7, the pressure in the exhaust gas line 24 upstream of the reduction catalyst 26 is used to control 1.5–2% additional air to a partial exhaust gas stream which is guided via the first partial stream line. In FIGS. 5, 6 and 7, the same reference numbers have been used for the corresponding parts to those of FIGS. 1, 2 and 3. New reference numbers have obviously been provided for new parts. In contrast to the first embodiment, the fuel is metered via a mechanical volume divider 50 and is injected by way of individual nozzles 51 which are disposed in the branch suction lines 14, 15, 16 and 17. The air is metered via a baffle valve 52 which acts via a lever 53 on a mechanical metering member 54. The restoring force acting on the metering member 54 is varied as a function of the output current of the oxygen measuring element 28 by means of the electronic control device 20. This variation causes the ratio of the air-fuel mixture to change.

A bypass 55, in which a Venturi nozzle 58 is disposed, branches from the exhaust line 24. The first partial air stream line 35 opens into the Venturi nozzle. The exhaust gas measuring element 28 is disposed downstream of the Venturi nozzle in the bypass 55. As shown in FIG. 5, this bypass can either discharge to the outside (indicated by broken lines) or it is returned to the suction pipe 13 for refluxing exhaust gas which also counteracts NOx formation. To prevent undesired condensation of the exhaust gas constituents when cooling occurs too suddenly in the bypass 55 and also to keep the δ error produced by supplementary cold air at a low value, the line 35 is heated by a heat exchanger 56. The heat exchanger 56 connects the first part of the bypass 55 to the line 35. An adjustable throttle 57 is disposed in the line 35 to obtain additional regulation of the air flow produced by the underpressure in the Venturi.

The supplementary air pump 32 can either be driven as represented by the engine 11 or by an electromotor. A constant pressure valve 59 is disposed in the pressure line 34 of the pump 32. The line 35 which is not restricted by throttle means and the line 36 which is controlled in this way branch off from the constant pressure valve 59. Control is effected by means of a diaphragm 60, one side of which is acted on by a line 61 by the pressure prevailing in the exhaust pipe 24 in the flow direction upstream of the reduction catalyst 26 and the other side is acted on by the pump pressure. The engagement of identical pressure at the diaphragm by discharging excess air into the line 36 is important to the accurate supplying of supplementary air to the Venturi nozzle 58.

In the embodiment represented in FIG. 6, the constant pressure valve 59 is not present and merely a storage device 63 is provided in the line 35. This storage device 63 helps to reduce the influence of the exhaust pulses on the control system.

In the variant represented in FIG. 7 the partial current line 35 does not branch off from the pressure line 34 of the air pump 32 but from the suction pipe 13 directly downstream of the filter 12.

What is claimed is:

1. A process for detoxicating the exhaust gases of an internal combustion engine having an exhaust line containing in series a first reactor for reducing nitrogen oxides and a second reactor for oxidizing hydrocarbons and carbon monoxide, and an oxygen measuring element connected to the exhaust line comprising the steps of:

a. regulating the mass ratio of air to fuel on the suction side of the engine as a function of the measured quantity of the oxygen measuring element;
b. injecting additional air into the exhaust line upstream of the oxidizing reactor in the form of a first and second air stream, the first one of which is injected in the exhaust flow direction upstream of the oxygen measuring element, and
c. regulating the first air stream at a quantity corresponding to the gas throughput of the engine, so that when the measuring element measures a stoichiometric mixture a slightly rich air-fuel mixture is supplied to the engine.

2. A process as defined in claim 1, wherein the internal combustion engine further has a pump which supplies, at least in part, the two air streams, the process further comprising:

d. driving the pump at an rpm corresponding to the rpm of the engine.

3. A process as defined in claim 1, wherein the internal combustion engine further has a suction pipe and a throttle valve mounted within the suction pipe, and wherein the step of regulating the first air stream is accomplished, at least indirectly, as a function of the pressure in the suction pipe downstream of the throttle valve.

4. A process as defined in claim 1, wherein the step of regulating the first air stream is accomplished as a function of the flow conditions in the exhaust line.

5. A system for detoxicating the exhaust gases of an internal combustion engine having a suction pipe, a throttle mounted within the suction pipe and an exhaust line containing in series a first reactor for reducing nitrogen oxides and a second reactor for oxidizing hydrocarbons and carbon monoxide, the system comprising:

a. a first control system including an oxygen measuring element connected to the exhaust line which regulates the mass ratio of air to fuel on the suction side of the engine as a function of the measured quantity of the oxygen measuring element;
b. a second control system including means for injecting additional air into the exhaust line upstream of the oxidizing reactor in the form of a first and second air stream through a first and second line, respectively, with the first air stream being injected in the exhaust flow direction upstream of the oxygen measuring element;
c. an air valve; and
d. a control line for connecting the air valve to the suction pipe, whereby the opening cross-section of said air valve corresponds to the pressure within the suction pipe, wherein:
   i. said air valve is also connected to at least one of the two air lines; and
   ii. said first air stream is regulated by said air valve and at least indirectly as a function of the pressure in the suction pipe downstream of the throttle valve at a quantity corresponding to the fuel throughput of the engine so that when the measuring element measures a stoichiometric mixture a slightly rich air-fuel mixture is supplied to the engine.

6. The system as defined in claim 5, wherein the means of said second control system includes an air pump and means connecting the air pump to the engine for driving the air pump at an rpm corresponding to the rpm of the engine.

7. The system as defined in claim 5, further comprising:

e. a throttle, wherein:
   i. said throttle is disposed in the second air line; and
   ii. said air valve is disposed in the first air line such that the cross-sectional area of flow of the first air stream is reduced as the vacuum pressure in the suction pipe increases.

8. The system as defined in claim 5, further comprising:

e. a throttle, wherein:
   i. said throttle is disposed in the first air line; and
   ii. said air valve is disposed in the second air line such that the cross-sectional area of flow of the second air stream is increased as the vacuum pressure in the suction pipe increases.

9. The system as defined in claim 5, wherein said air valve comprises a three-way valve which controls the distribution of additional air to form the first and second air streams, the total flow cross-sectional area thereof being preferably constant.

10. The system as defined in claim 5, further comprising:

e. a bypass, wherein:

i. said first air stream is regulated as a function of the flow conditions in the exhaust line;

ii. the oxygen measuring element is disposed in the bypass; and iii. the bypass branches off from the exhaust line upstream of the reactors.

11. The system as defined in claim 10, wherein the bypass discharges into the suction pipe preferably in the flow direction upstream of the throttle valve.

12. The system as defined in claim 10, further comprising:

f. a compensating storage element, wherein:

i. said storage element is formed as a cross-section enlargement of the first air line; and ii. said storage element compensates for exhaust pulses.

13. The system as defined in claim 10, further comprising:

f. a Venturi nozzle, wherein:

i. said first air stream discharges into said Venturi nozzle; and ii. said Venturi nozzle is disposed in said bypass in the flow direction upstream of the oxygen measuring element.

14. The system as defined in claim 13, further comprising:

g. a throttle disposed in the first air line.

15. The system as defined in claim 10, wherein said air valve comprises a three-way valve which controls the cross-sectional flow passage of the second air stream as a function of the pressure in the exhaust line.

16. The system as defined in claim 15, wherein said air valve includes a diaphragm which is acted on on one side by the pressure in the exhaust line and on the other side by the pressure of the additional air.

* * * * *